US011018445B2

(12) United States Patent
Endo et al.

(10) Patent No.: US 11,018,445 B2
(45) Date of Patent: May 25, 2021

(54) TERMINAL WITH ELECTRICALLY CONDUCTIVE TUBULAR SHAPED BODY PORTION

(71) Applicant: DAI-ICHI SEIKO CO., LTD., Kyoto (JP)

(72) Inventors: Takayoshi Endo, Shizuoka (JP); Seiji Sasaki, Shizuoka (JP)

(73) Assignee: DAI-ICTII SEIKO CO., LTD., Kyoto (JP)

( * ) Notice: Subject to any disclaimer, the term of this patent is extended or adjusted under 35 U.S.C. 154(b) by 0 days.

(21) Appl. No.: 16/671,680

(22) Filed: Nov. 1, 2019

(65) Prior Publication Data

US 2020/0169023 A1 May 28, 2020

(30) Foreign Application Priority Data

Nov. 27, 2018 (JP) ..... JP2018-220891

(51) Int. Cl.
*H01R 13/11* (2006.01)
*H01R 4/18* (2006.01)

(52) U.S. Cl.
CPC ..... *H01R 13/11* (2013.01); *H01R 4/185* (2013.01)

(58) Field of Classification Search
CPC ..... H01R 13/111; H01R 13/113; H01R 4/185
USPC ..... 439/851, 852, 861
See application file for complete search history.

(56) References Cited

U.S. PATENT DOCUMENTS 4,560,231 A * 12/1985 Shirai ..... H01R 13/114 439/843
4,735,581 A * 4/1988 Endo ..... H01R 13/5205 439/279
5,593,328 A * 1/1997 Okada ..... H01R 13/11 439/843
6,024,612 A * 2/2000 Myer ..... H01R 13/113 439/744
6,062,918 A 5/2000 Myer et al.
(Continued)

FOREIGN PATENT DOCUMENTS

CN 1360368 A 7/2002
CN 1653650 A 8/2005
(Continued)

OTHER PUBLICATIONS

Notification of First Office Action (CN Application or Patent No. 201911181102.7); dated Dec. 3, 2020; 19 pages; Includes English Translation.

*Primary Examiner* — Abdullah A Riyami
*Assistant Examiner* — Marcus E Harcum
(74) *Attorney, Agent, or Firm* — Howard & Howard Attorneys PLLC

(57) ABSTRACT

A terminal includes a body portion and an elastic plate. The body portion is made of an electrically conductive material, is formed into a tubular shape extending in a tube axial direction, and has an insertion opening for insertion of a mating terminal therethrough. An elastic plate is made of an electrically conductive material extending, inside the body portion, in the tube axial direction and is folded back such that an arched portion faces the insertion opening, for the elastic plate to contact with the mating terminal. The elastic plate includes a first plate spring portion and a second plate spring portion overlapping the first plate spring portion.

13 Claims, 19 Drawing Sheets

(56) References Cited

U.S. PATENT DOCUMENTS 6,165,026 A * 12/2000 Sugie ..... H01R 13/432 439/746
6,312,762 B1 * 11/2001 Sugawara ..... C22F 1/02 148/276
6,851,989 B2 * 2/2005 Maeda ..... H01R 43/16 439/748
7,252,564 B1 * 8/2007 Morello ..... H01R 4/185 439/843
7,294,027 B1 * 11/2007 Tyler ..... H01R 13/187 439/845
7,303,447 B1 * 12/2007 Tyler ..... H01R 9/031 439/746
7,458,864 B2 * 12/2008 Philipp ..... H01R 13/113 439/851
8,241,075 B2 * 8/2012 Ishikawa ..... H01R 13/113 439/851
2001/0002350 A1 * 5/2001 Kashiyama ..... H01R 13/11 439/848
2001/0027068 A1 * 10/2001 Heimueller ..... H01R 13/11 439/851
2002/0076999 A1 * 6/2002 Chen ..... H01R 13/187 439/851
2002/0077000 A1 * 6/2002 Nimura ..... H01R 43/16 439/852
2004/0224573 A1 * 11/2004 Yoshida ..... H01R 13/11 439/852
2005/0153605 A1 * 7/2005 Anbo ..... H01R 13/113 439/852
2006/0172621 A1 * 8/2006 Noro ..... H01R 13/115 439/852
2007/0021013 A1 * 1/2007 Myer ..... H01R 13/113 439/852
2007/0243772 A1 * 10/2007 Kaneko ..... H01R 13/113 439/852
2008/0070452 A1 * 3/2008 Komiyama ..... H01R 13/113 439/852
2010/0041283 A1 * 2/2010 Hernandez ..... H01R 13/113 439/851
2010/0197177 A1 * 8/2010 Myer ..... H01R 13/113 439/852
2011/0212656 A1 * 9/2011 Suzuki ..... H01R 13/114 439/852
2012/0315806 A1 * 12/2012 Myer ..... H01R 13/113 439/861
2013/0288547 A1 * 10/2013 Amano ..... H01R 13/11 439/852
2014/0287634 A1 * 9/2014 Tsuji ..... H01R 13/113 439/852
2016/0064845 A1 * 3/2016 Endo ..... H01R 13/11 439/884
2020/0028294 A1 * 1/2020 Nagano ..... H01R 4/188
2020/0313330 A1 * 10/2020 Sugimoto ..... H01R 13/193

FOREIGN PATENT DOCUMENTS

CN 1909297 A 2/2007
CN 101651267 A 2/2010
EP 0755579 A1 1/1997
JP 3388170 B2 3/2003

* cited by examiner

TERMINAL WITH ELECTRICALLY CONDUCTIVE TUBULAR SHAPED BODY PORTION

CROSS-REFERENCE TO RELATED APPLICATION

This application claims priority to Japanese Patent Application No. 2018-220891, filed on Nov. 27, 2018, the entire disclosure of which is incorporated by reference herein.

FIELD

This application relates to a terminal.

BACKGROUND

Japanese Patent No. 3388170 discloses a female side terminal including an elastic contact piece that bends inside a box-shaped body portion to contact a male side mating terminal inserted into the inside part of the box-shaped body portion, and an auxiliary elastic piece that is placed on the back side of the elastic contact piece.

In the terminal disclosed in Japanese Patent No. 3388170, the elastic contact piece is bent back centered on the central axis parallel to a longitudinal direction of the box-shaped body portion. Thus, the mating terminal inserted into the body portion contacts the elastic contact piece in a state of imbalance along a lateral direction orthogonal to the longitudinal direction. Consequently, reliability of contact between the mating terminal and the terminal may be insufficient.

The present disclosure is made in view of the foregoing circumstances, and an objective of the present disclosure is to improve the reliability of contact of the terminal with the mating terminal.

SUMMARY

In order to attain the aforementioned objectives, a terminal includes a body portion made of an electrically conductive material, having a tubular shape extending in a tube axial direction, and comprising an insertion opening through which a mating terminal is to be inserted; and an elastic plate made of an electrically conductive material, extending inside the body portion in the tube axial direction, and comprising an arched portion folded back to face the insertion opening, the elastic plate being configured to contact with the mating terminal upon insertion of the mating terminal into the insertion opening, wherein the elastic plate includes a first plate spring portion and a second plate spring portion overlapping the first plate spring portion.

The elastic plate may have a restricting portion, the restricting portion being formed at one of the first plate spring portion and the second plate spring portion, and may be configured to restrict displacement between the first plate spring portion and the second plate spring portion.

The restricting portion may restrict sliding movement of the first plate spring portion and the second plate spring portion relative to each other in a direction other than the tube axial direction.

The restricting portion may be a pair of projections sandwiching another one of the first plate spring portion and the second plate spring portion.

The pair of projections may protrude and may be folded from both side end faces of the one of the first plate spring portion and the second plate spring portion.

The body portion may have exposure openings that expose the pair of the projections to the outside of the body portion.

Another one of the first plate spring portion and the second plate spring portion may have a hole, a dent, or a notch, and the restricting portion may be formed at the one of the first plate spring portion and the second plate spring portion, and may be the projection that fits in the hole, the dent, or the notch.

The projection may be formed by pressing the one of the first plate spring portion and the second plate spring portion from a surface opposite to surfaces of the first plate spring portion and the second plate spring portion facing each other.

The projection may be formed by cutting and raising up the one of the first plate spring portion and the second plate spring portion.

The elastic plate may have a first end on a distal end side that extends and is folded such that an arched portion faces the insertion opening, and the restricting portion may be formed at the first end.

The elastic plate may have a coupling portion that couples the first plate spring portion and the second plate spring portion to each other, and the first plate spring portion, the second plate spring portion, and the coupling portion may be formed integrally from a single electrically conductive plate.

The elastic plate may have, on a base end side, a second end that is connected to a portion where the insertion opening is formed, and the coupling portion may be formed at the second end.

The first plate spring portion and the second plate spring portion may be separately formed from different electrically conductive plates.

A plate thickness of the second plate spring portion may be less than a plate thickness of the first plate spring portion.

The first plate spring portion may have a contact portion that is to be in contact with the mating terminal, and the second plate spring portion may be disposed, at an inner side, on the first plate spring portion folded back such that an arched portion faces the insertion opening.

According to the present disclosure, an elastic plate is folded back such that an arched portion faces an insertion opening and extends inside a body portion in a tube axial direction. With this configuration, a mating terminal inserted through the insertion opening contacts the elastic plate in a state of stable balance along the lateral direction orthogonal to the tube axial direction. As a result, the reliability of contact of the terminal with the mating terminal can be improved.

BRIEF DESCRIPTION OF THE DRAWINGS

A more complete understanding of this application can be obtained when the following detailed description is considered in conjunction with the following drawings, in which.

DETAILED DESCRIPTION

Embodiment 1

Figure 1:
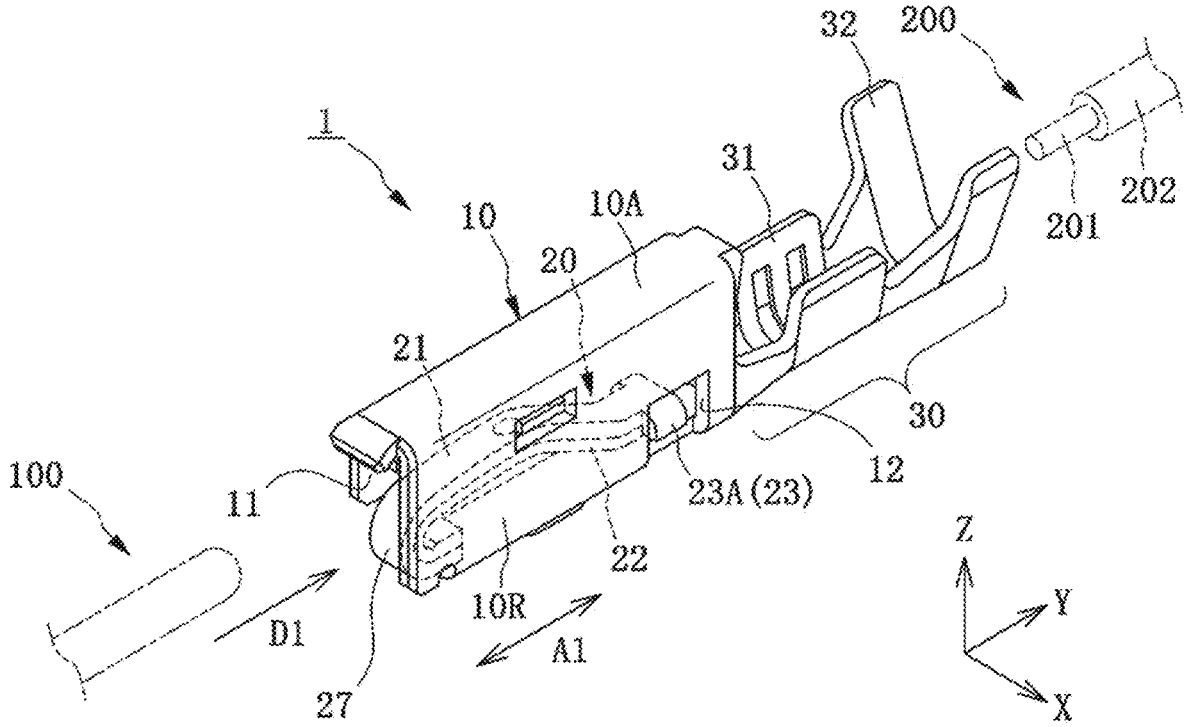
FIG. 1 is a perspective view (part 1) of a terminal according to Embodiment 1 of the present disclosure.
Figure 2:
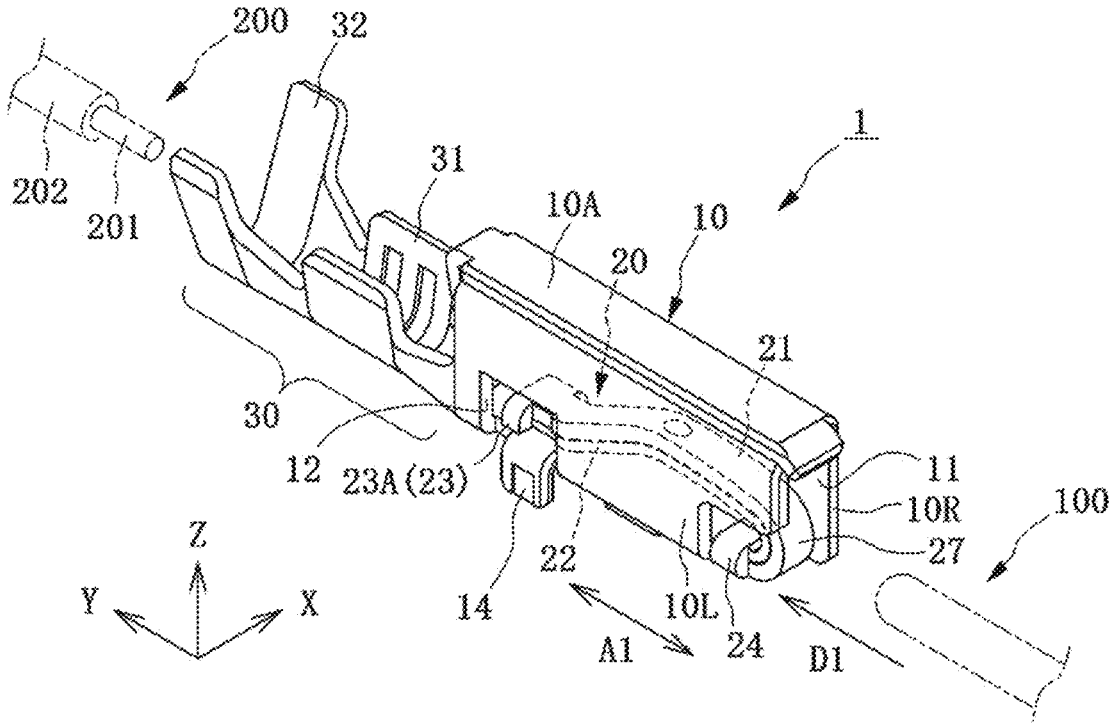
FIG. 2 is another perspective view (part 2) of the terminal according to Embodiment 1.

Hereinafter, a terminal 1 according to Embodiment 1 of the present disclosure is described with reference to FIGS. 1 to 10. For ease of understanding, XYZ coordinates are applied to the figures and referred to as appropriate. As shown in FIGS. 1 and 2, a Y-axis direction in the XYZ coordinates is identical to an insertion direction D1 in which a mating terminal 100 is inserted into the terminal 1 for connection of the mating terminal 100 with the terminal 1. An X-axis direction and a Z-axis direction are orthogonal to the insertion direction D1.

Figure 3:
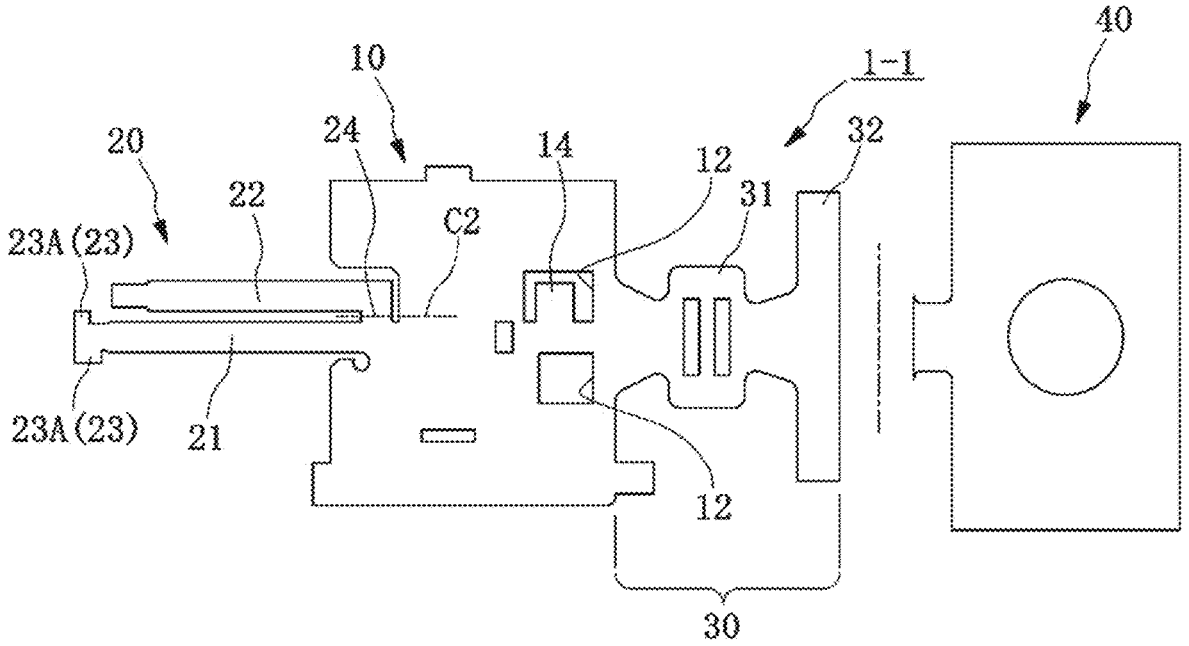
FIG. 3 is a developed view of the terminal according to Embodiment 1.
Figure 4:
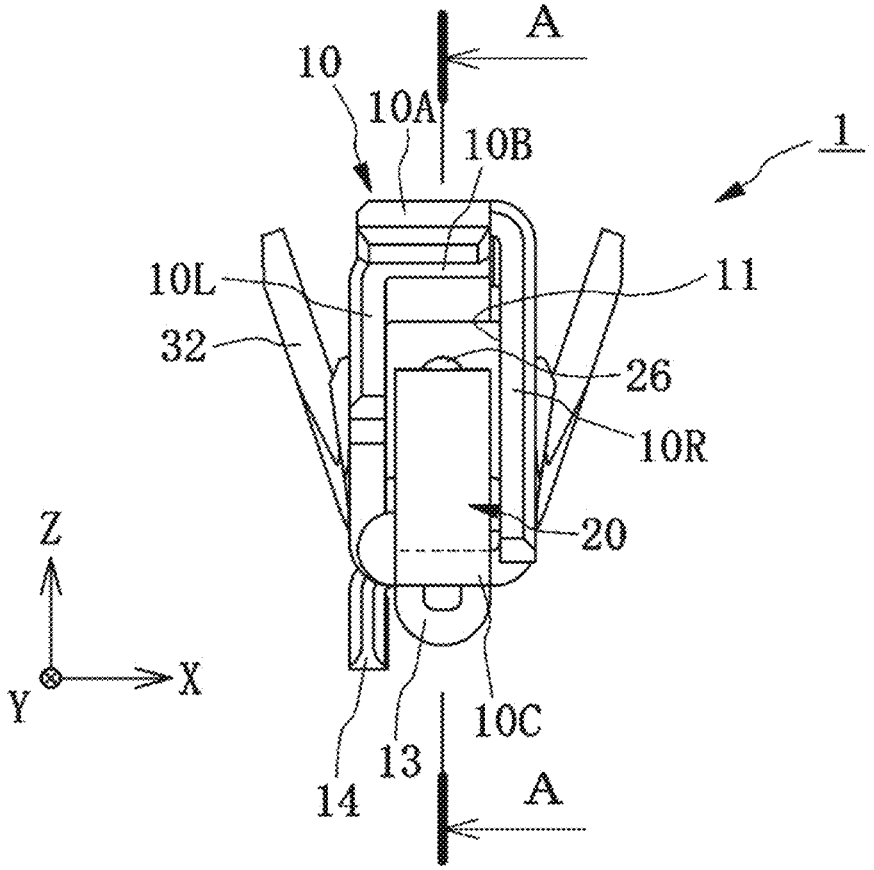
FIG. 4 is a front view of the terminal according to Embodiment 1.
Figure 5:
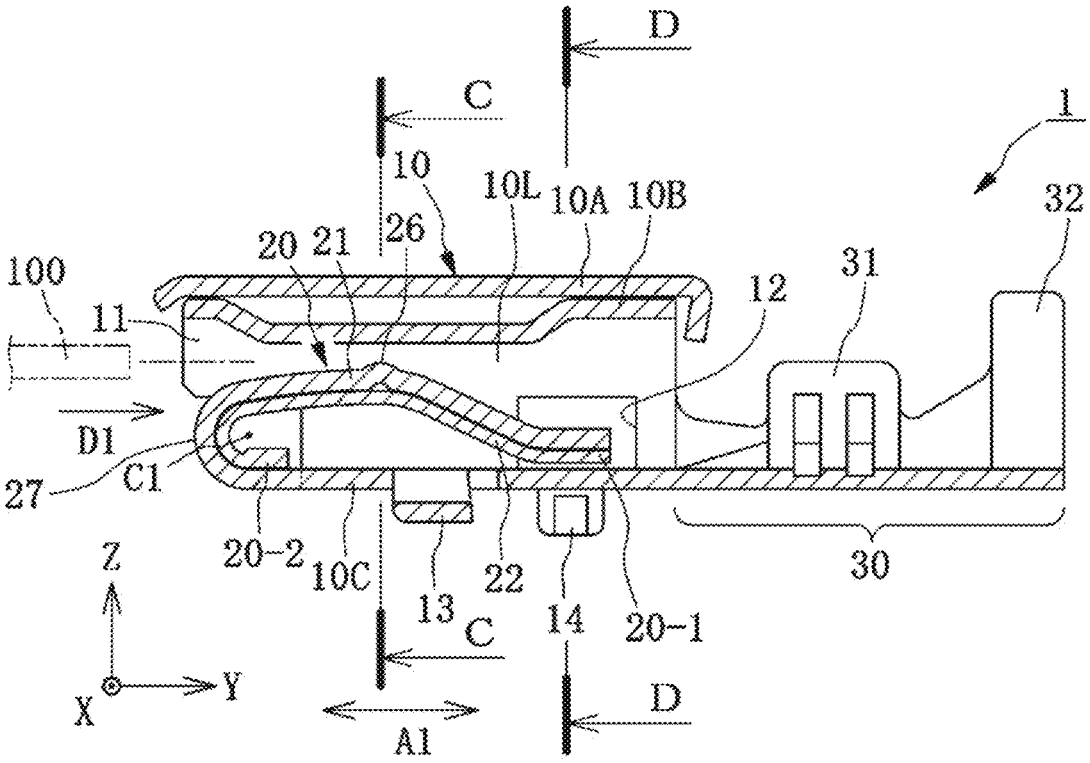
FIG. 5 is a cross-sectional view taken along the line A-A in FIG. 4.

The terminal 1 is used as a connector that is an electronic circuit component installed in an automobile component, for example. The terminal 1 is a female terminal with a shape extending in the Y-axis direction. According to Embodiment 1, the terminal 1 is formed by folding a single electrically conductive plate 1-1 disconnected from a carrier 40 as illustrated in FIG. 3. This terminal 1 includes a body portion 10, an elastic plate 20, and a crimp portion 30, as shown in FIGS. 4 and 5.

The body portion 10 is a member that is made of an electrically conductive material such as copper and copper alloy and that internally supports the elastic plate 20. The body portion 10 includes top plates 10A, 10B, a bottom plate 10C, and sidewall plates 10R, 10L and is formed into a square-shaped tube extending in a tube axial direction A1. The two top plates 10A, 10B overlap each other. Between the sidewall plate 10R and sidewall plate 10L of the body portion 10, the elastic plate 20 is disposed facing the bottom plate 10C. In addition, the body portion 10 includes an insertion opening 11, exposure openings 12, a lance locking member 13, and an upside-down insertion preventing projection 14.

The insertion opening 11 is an opening through which the mating terminal 100 is inserted. The insertion opening 11 is formed at an end on the −Y side of the body portion 10.

The exposure openings 12 are openings for exposing a later described restricting portion 23 of the elastic plate 20 to the outside of the body portion 10, as shown in FIGS. 1 and 2. The exposure openings 12 are formed in the sidewall plates 10R and 10L of the body portion 10.

The lance locking member 13, as illustrated in FIG. 5, engages a lance formed in a non-illustrated connector housing to hold the terminal 1 in the connector housing in a state in which the terminal 1 cannot be pulled out. The lance locking member 13 is provided at the bottom plate 10C.

The upside-down insertion preventing projection 14 projects from the bottom plate 10C in the −Z direction. When an operator inserts the terminal 1 into a terminal housing of the connector housing, the upside-down insertion preventing projection 14 prevents the terminal 1 from being inserted upside down.

The elastic plate 20 is formed from a single plate material made of copper, copper alloy, or the like, and thus has elasticity and electrical conductivity. The elastic plate 20 is folded back centered on an axis parallel to the X-axis direction to cause the arched portion 27 to face the insertion opening 11, and extends inside the body portion 10 in the tube axial direction Al as illustrated in FIGS. 1 and 2. The elastic plate 20 has a protruding portion formed into a smooth circular arc shape and protrudes towards the +Z-side as shown in FIG. 5. The elastic plate 20, as shown in FIGS. 1 and 2, includes a first plate spring portion 21, a second plate spring portion 22 overlapping the first plate spring portion 21, a restricting portion 23 that suppresses or regulates the displacement between two plate spring portions 21 and 22, and a coupling portion 24.

The first plate spring portion 21 is, as shown in FIGS. 6A, 6B, 7A, and 7B, an outer spring that extends from the body portion 10 and is folded back at the axis C1 that is parallel to the X-axis direction. The first plate spring portion 21 includes a contact portion 26 which the mating terminal 100 contacts.

The second plate spring portion 22 is an inner spring disposed on the inner side of the folded first plate spring portion 21. In the present Embodiment 1, the second plate spring portion 22 has a plate thickness t2 thinner than a plate thickness t1 of the first plate spring portion 21. In addition, the first plate spring portion 21 has the plate thickness t1 equal to a plate thickness t3 of the body portion 10.

The restricting portion 23 restricts sliding movement of the first plate spring portion 21 and the second plate spring portion 22 relative to each other in any direction other than the tube axial direction A1 (a direction parallel to the Y-axis direction). Specifically, the restricting portion 23 is configured to restrict sliding movement of the two plate spring portions 21 and 22 relative to each other in a lateral direction A2 (a direction parallel to the X-axis direction). In the present Embodiment 1, the restricting portion 23 protrudes from the both side end faces 21*b* of the first plate spring portion 21 and bends to form a pair of projections 23A sandwiching the second plate spring portion 22. In addition, the restricting portion 23 is formed at the first end 20-1 on the distal end side of the elastic plate 20 that is folded back and extends such that the arched portion 27 faces the insertion opening 11. As illustrated in FIGS. 1 and 2, the pair of the projections 23A is exposed to the outside through the exposure openings 12.

Figure 6A:
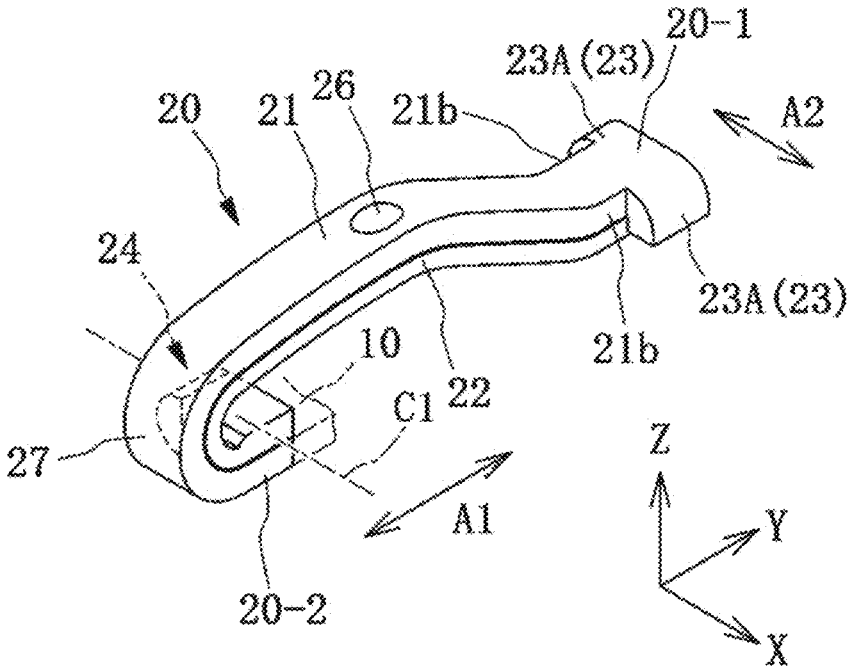
FIG. 6A is a perspective view (part 1) of an elastic plate according to Embodiment 1.
Figure 6B:
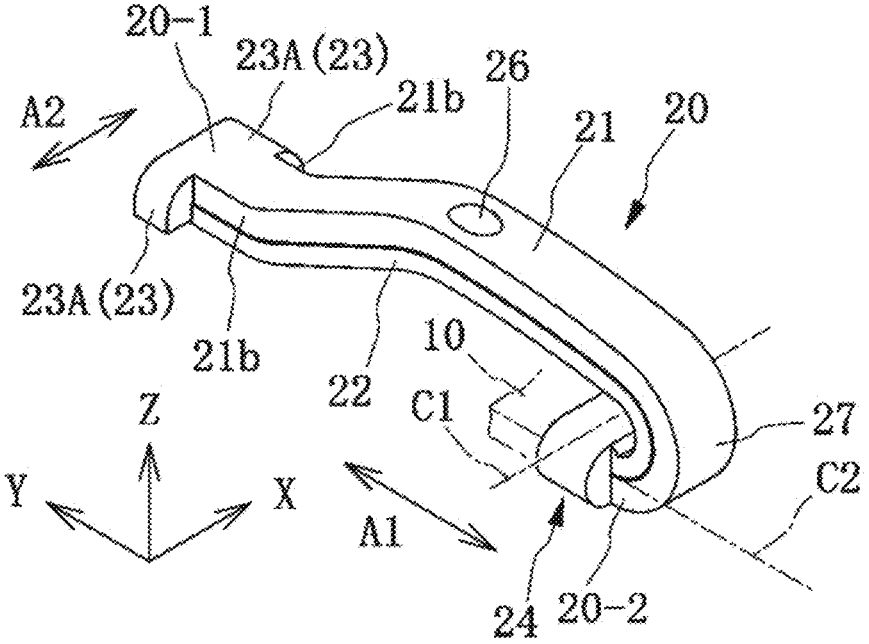
FIG. 6B is another perspective view (part 2) of the elastic plate according to Embodiment 1.

As illustrated in FIGS. 2, 6A and 6B, the coupling portion 24 couples the two plate spring portions 21 and 22 together. The coupling portion 24 is formed at the second end 20-2 on a base end side of the elastic plate 20 that is connected to the portion forming the insertion opening 11. As illustrated in FIG. 6B, the coupling portion 24 is folded back at the axis C2 that is parallel to the Y-axis direction.

The crimp portion 30 includes, as illustrated in FIGS. 1 and 2, a conductor crimping part 31 and a sheath holder 32. The conductor crimping part 31 is crimped and is electrically connected with a conductive core 201 of an electric wire 200. The sheath holder 32 presses an end of an insulating sheath 202 of the electric wire 200 through crimping to protect the connection between the conductor crimping part 31 and the core 201 from pullout force.

As described above, in Embodiment 1, the elastic plate 20 is folded back such that the arched portion 27 faces the insertion opening 11 and extends inside the body portion 10 in the tube axial direction A1 in the manner illustrated in FIGS. 1 and 2. With this configuration, as illustrated in FIG. 8A, the mating terminal 100 inserted through the insertion opening 11 contacts the elastic plate 20 in a state where the balance along the lateral direction A2 thereof is stable.

Figure 8A:
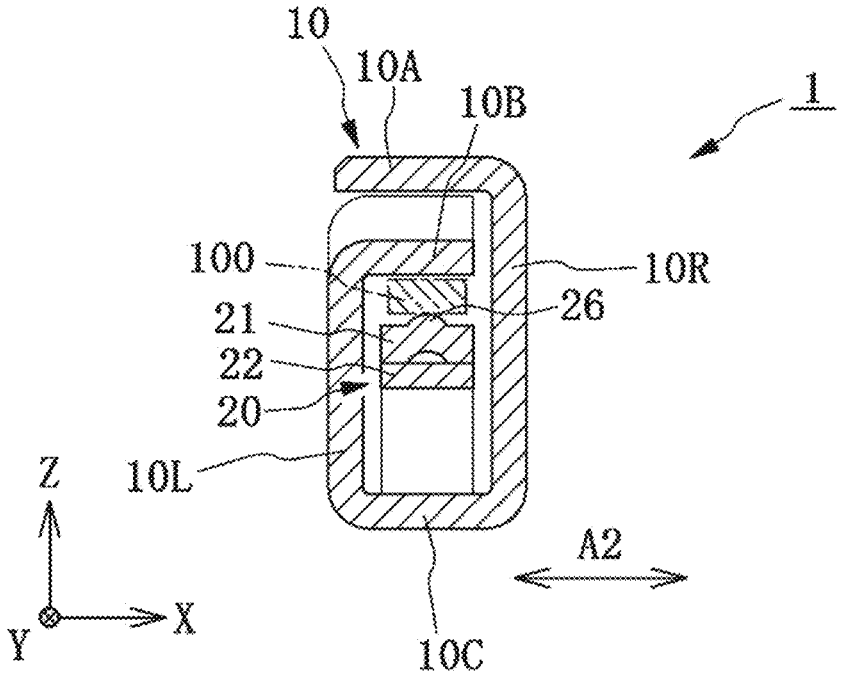
FIG. 8A is a cross-sectional view taken along the line C-C in FIG. 5.
Figure 8B:
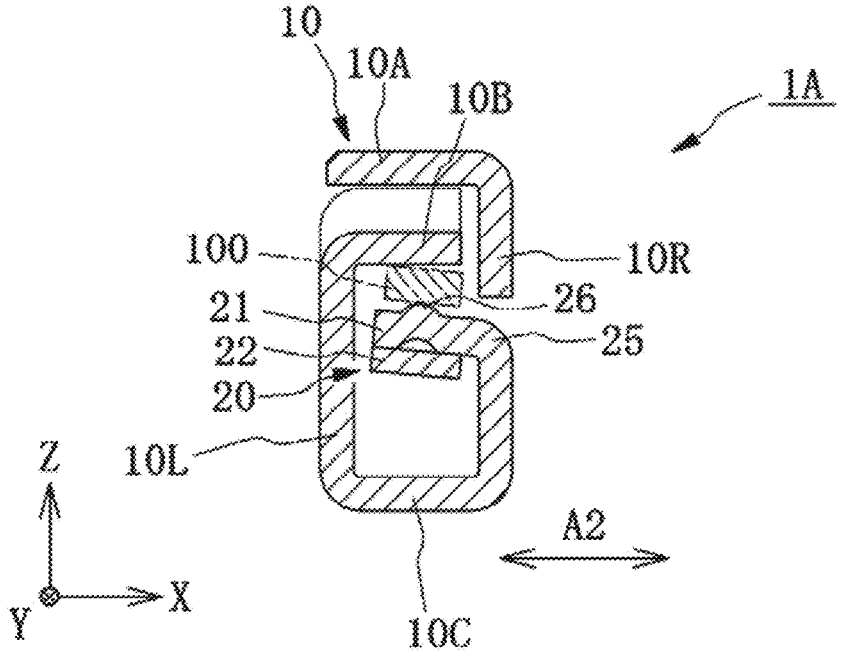
FIG. 8B is a cross-sectional view of a terminal according to a comparative example.

In contrast, in a terminal 1A according to a comparative example, the elastic plate 20 is folded back parallel to the Y-axis direction by a bent portion 25, as illustrated in FIG. 8B. With this configuration, the mating terminal 100 inserted through the insertion opening 11 contacts the elastic plate 20 in a state of unstable balance along the lateral direction A2. Consequently, the reliability of contact of the mating terminal 100 with the terminal 1A can be insufficient.

However, according to the present Embodiment 1, as may be understood with reference to FIGS. 5, 8A and 8B, the elastic plate 20 is folded back centered at an axis C1 that is parallel to the X-axis direction such that the arched portion 27 faces the insertion opening 11. With this configuration, the mating terminal 100 inserted through the insertion opening 11 contacts the elastic plate 20 in a state of stable balance along the lateral direction A2. As a result, the reliability of contact of the terminal 1 with the mating terminal 100 can be improved.

In addition, according to the present Embodiment 1, the elastic plate 20 has the restricting portion 23 as illustrated in FIGS. 6A, 6B, 7A, and 7B. With this configuration, the occurrence of the displacement between the two plate spring portions 21 and 22 can be suppressed. As a result, the reliability of contact of the terminal 1 with the mating terminal 100 can be improved.

Figure 9A:
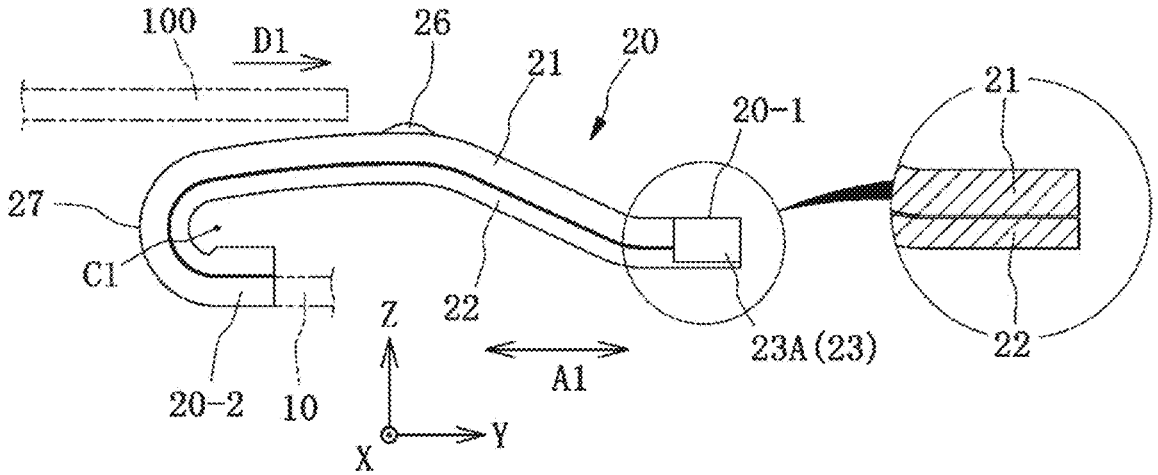
FIG. 9A is a side view of the elastic plate before contacting a mating terminal according to Embodiment 1.
Figure 9B:
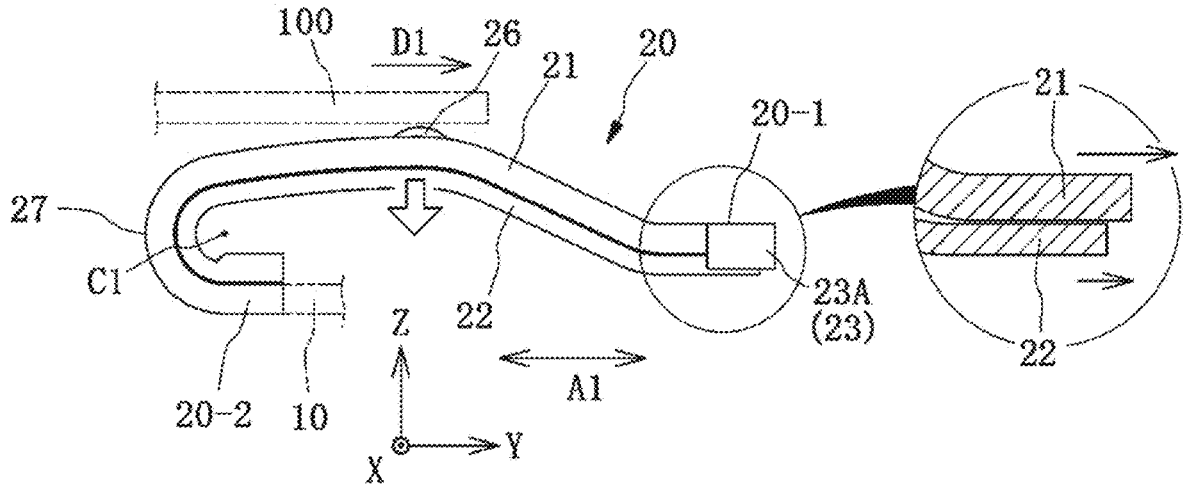
FIG. 9B is a side view of the elastic plate after contacting the mating terminal according to Embodiment 1.

In addition, according to the present Embodiment 1, the restricting portion 23 is configured to restrict sliding movements of the two plate spring portions 21 and 22 relative to each other in a lateral direction A2. With this configuration, as illustrated in FIGS. 9A and 9B, lateral sliding movement of the two plate spring portions 21 and 22 relative to each other is restricted while a sliding movement of the two plate spring portions 21 and 22 relative to each other in the tube axial direction A1 is allowed. Thus, in the terminal 1, since the two plate spring portions 21 and 22 are restricted from sliding movement in the tube axial direction A1 upon insertion of the mating terminal 100, pressure to hold the mating terminal 100 can be stabilized. As a result, the reliability of contact of the terminal 1 with the mating terminal 100 can be improved.

Figure 10:
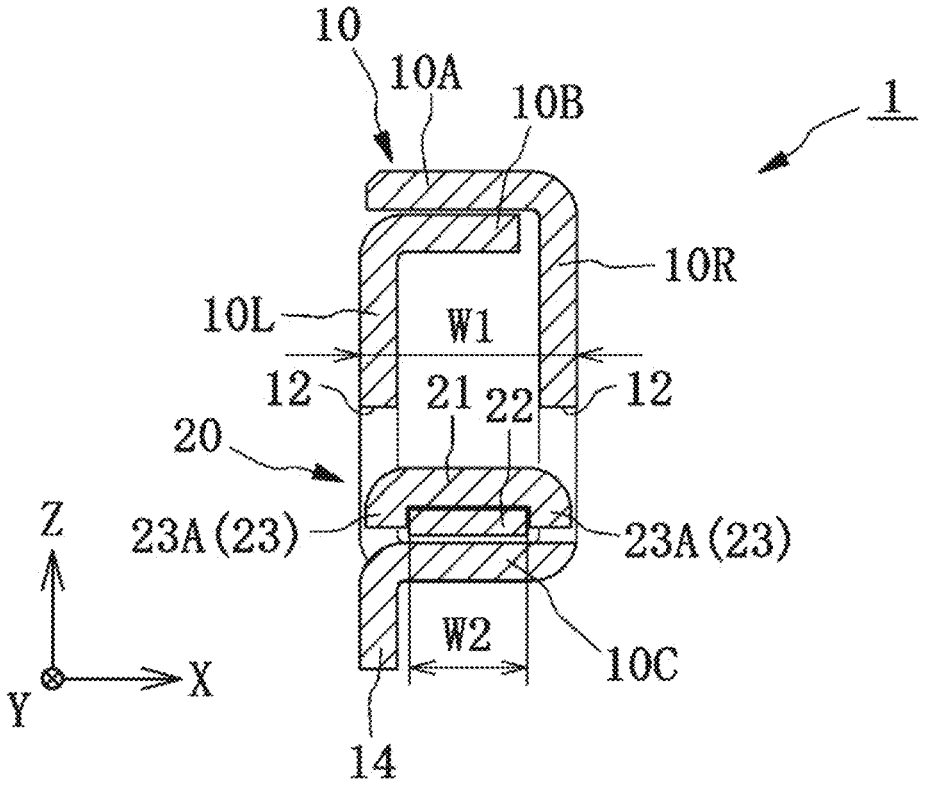
FIG. 10 is a cross-sectional view taken along the line D-D in FIG. 5.

In addition, the present Embodiment 1, the body portion 10 illustrated in FIG. 10 has the exposure openings 12 for exposing a pair of projections 23A to the outside of the body portion 10. This configuration enables the terminal 1 to secure, at portions other than the restricting portion 23, a width W2 (length in the direction of the X axis) of increased size for the elastic plate 20, and while improving elasticity of the elastic plate 20, enables the body portion 10 to have a decreased width W1 (length in the X-axis direction). With this configuration, the reliability of contact of the terminal 1 with the mating terminal 100 can be improved while achieving reduction in overall size of the terminal 1.

According to present Embodiment 1, the restricting portion 23 (the projections 23A) are formed at the first plate spring portion 21, and sandwich the second plate spring portion 22. However, the present disclosure is not limited to this configuration. The restricting portion 23 (the projections 23A) may be formed at the second plate spring portion 22, and can sandwich the first plate spring portion 21.

Embodiment 2

Figure 11:
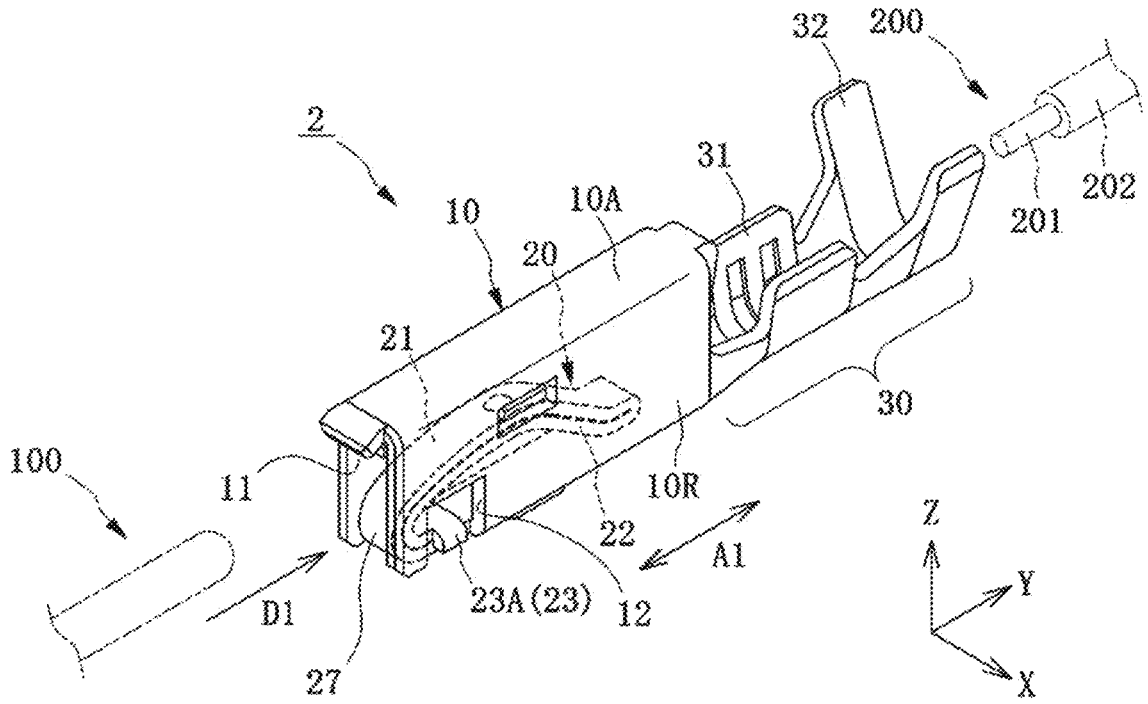
FIG. 11 is a perspective view of a terminal according to Embodiment 2.
Figure 12:
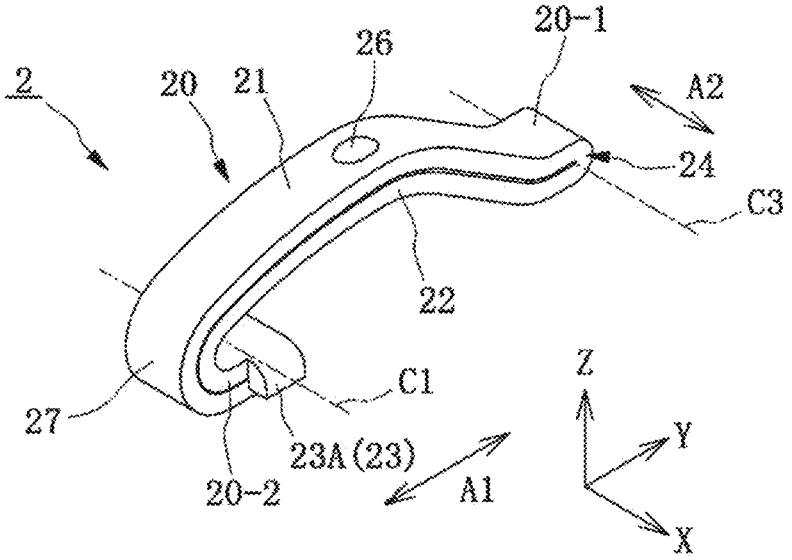
FIG. 12 is a perspective view of an elastic plate according to Embodiment 2.
Figure 13:
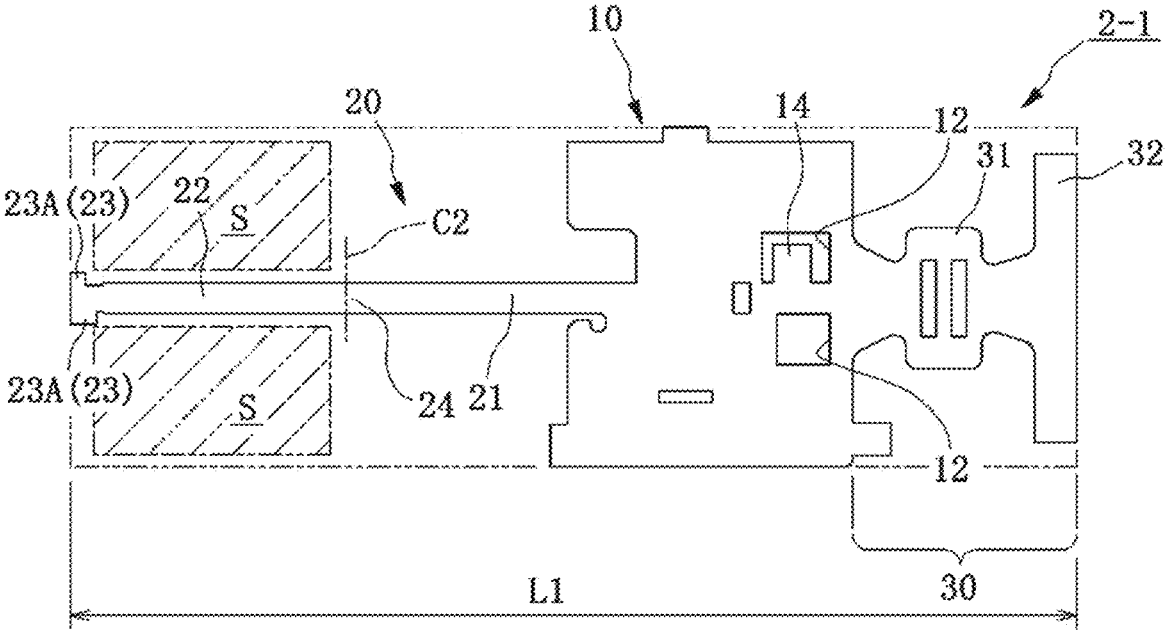
FIG. 13 is a developed view of the terminal according to Embodiment 2.

In the terminal 1 according to Embodiment 1 of the present disclosure, the coupling portion 24 of the elastic plate 20 is folded back centered at an axis C2 that is parallel to the Y-axis direction, as illustrated in FIG. 6B. However, the present disclosure is not limited to this configuration. In a terminal 2 according to Embodiment 2 as illustrated in FIGS. 11 and 12, the coupling portion 24 may be folded back centered on an axis C3 that is parallel to the X-axis direction. In this case, the coupling portion 24 is formed at the first end 20-1 on the distal end side of the elastic plate 20, and the restricting portion 23 is formed at the second end 20-2 on the base end side connected to the insertion opening 11. This terminal 2 can achieve an effect similar to that of the terminal 1. Note that in the terminal 2, as shown in FIG. 13, a length L1 of a plate material before punching to obtain a plate 2-1 that forms the terminal 2 is to be greater than that of the plate material before punching to obtain a plate 1-1 (see FIG. 3) that forms the terminal 1. In addition, the plate material before subjected to punching to obtain the plate 2-1 has spaces S that do not contribute to formation of the terminal 2. Thus, the shape of the terminal 1 according to Embodiment 1 may be used in view of the cost for the plate material.

Embodiment 3

Figure 14A:
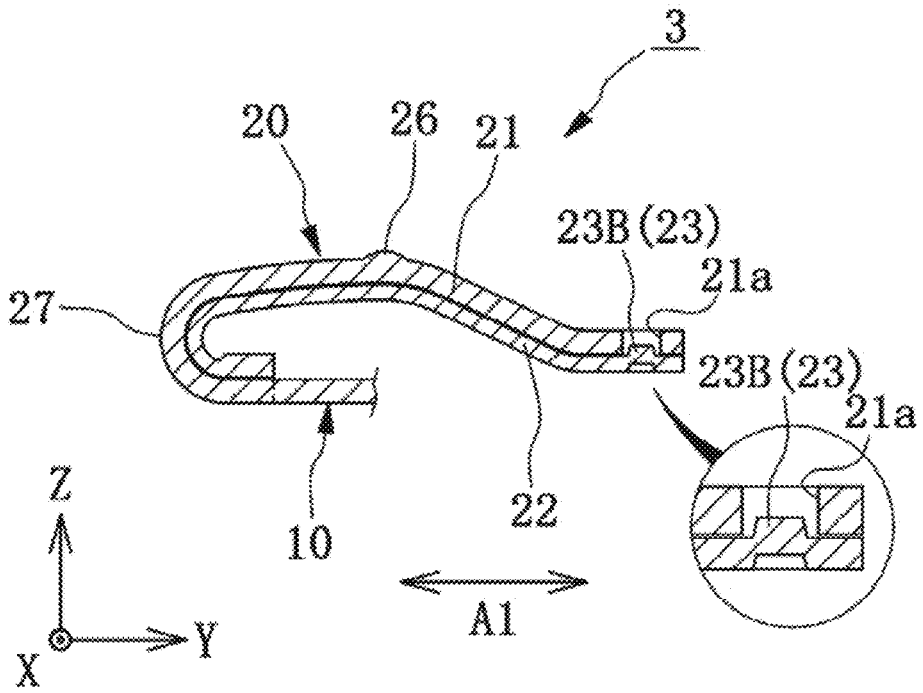
FIG. 14A is a cross-sectional view of an elastic plate according to Embodiment 3.
Figure 14B:
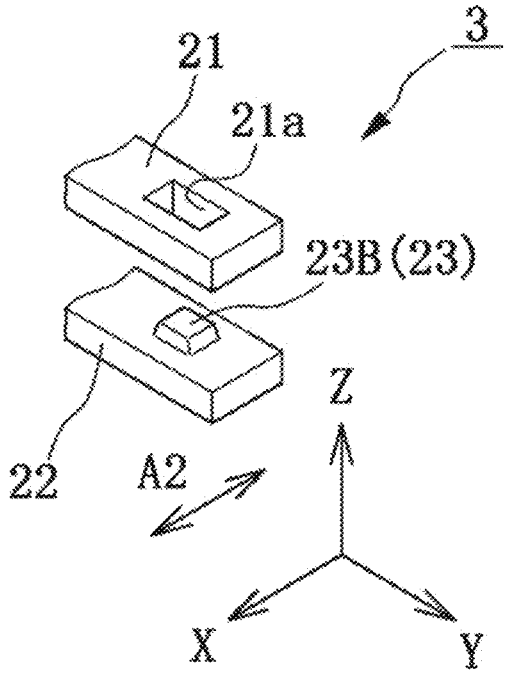
FIG. 14B is an enlarged perspective view of an end of the elastic plate according to Embodiment 3.

In the terminal 1 according to Embodiment 1 of the present disclosure, as shown in FIGS. 6A, 6B, 7A, and 7B, the restricting portion 23 is a pair of projections 23A sandwiching the second plate spring portion 22. However, the present disclosure is not limited to this configuration. The restricting portion 23 can have shapes other than that of the projections 23A, as long as the shape enables restriction of sliding movement of the two plate spring portions 21 and 22 relative to each other in the lateral direction A2. For example, in a terminal 3 according to Embodiment 3 as illustrated in FIGS. 14A and 14B, the restricting portion 23 may be a projection 23B for fitting into a hole 21*a* formed in the first plate spring portion 21. For example, the projection 23B is formed by pressing with punch the second plate spring portion 22 from the back surface (the surface at the −Z-side) toward the +Z direction. In addition, the hole 21*a* may be formed, for example, as a long hole having a longitudinal direction in the Y-axis direction so as to allow the two plate spring portions 21 and 22 to slidably move relative to each other in the tube axial direction A1.

According to the present Embodiment 3, the restricting portion 23 (the projection 23B) and the hole 21*a* are respectively formed in the second plate spring portion 22 and the first plate spring portion 21. However, the present disclosure is not limited to this configuration. Alternatively, the restricting portion 23 (the projection 23B) and the hole 21*a* may be respectively formed in the first plate spring portion 21 and the second plate spring portion 22.

Furthermore, according to the present Embodiment 3, the hole 21*a* is a through hole penetrating the first plate spring portion 21 in the plate thickness direction (in the Z-axis direction). However, the present disclosure is not limited to this configuration. A shape other than that of the hole 21*a* may be used, as long as the shape enables fitting of the projection 23B. For example, this shape may be that of a dent that does not penetrate in the plate thickness direction, or may be that of a notch.

Embodiment 4

Figure 15A:
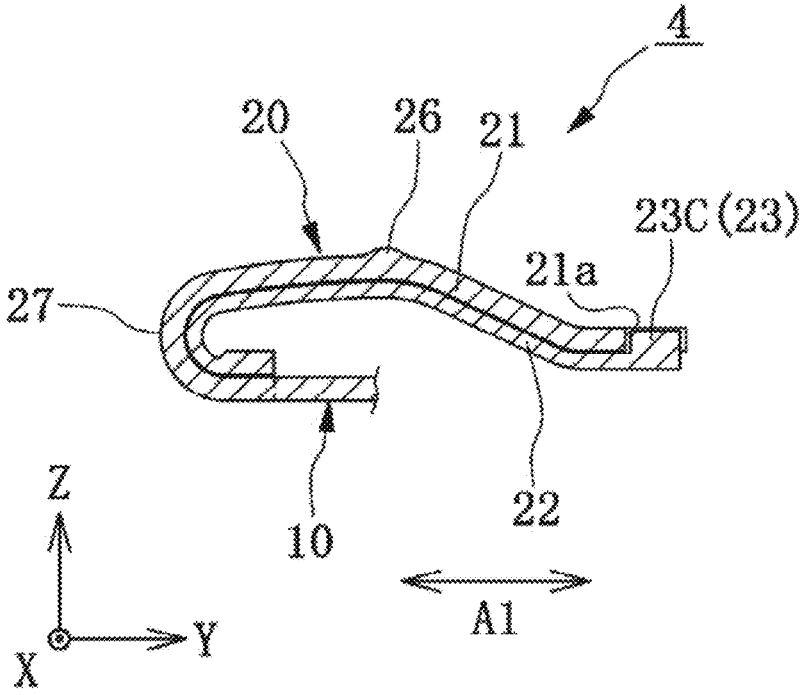
FIG. 15A is a cross-sectional view of an elastic plate according to Embodiment 4.
Figure 15B:
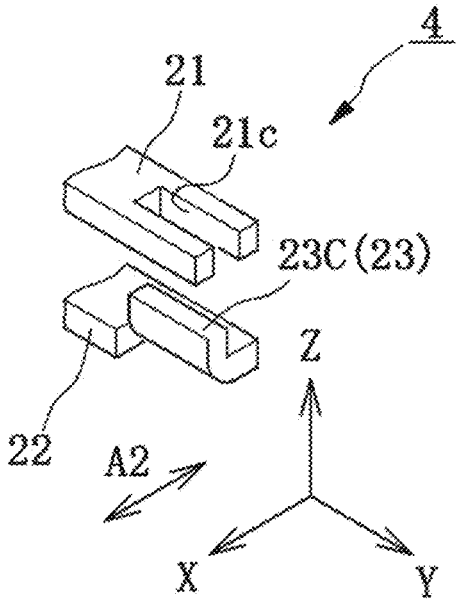
FIG. 15B is an enlarged perspective view of an end of the elastic plate according to Embodiment 4.

The restricting portion 23 may have a shape other than those of the projection 23A of Embodiment 1 and the projection 23B of Embodiment 3, as long as the shape enables restriction of sliding movement of the two plate spring portions 21 and 22 relative to each other in the lateral direction A2. For example, in a terminal 4 illustrated in FIGS. 15A and 15B according to Embodiment 4, the restricting portion 23 can be a projection 23C that fits into the notch 21*c* formed in the first plate spring portion 21. The projection 23C is, for example, formed by cutting and raising up a portion of the second plate spring portion 22.

According to the present Embodiment 4, the restricting portion 23 (the projection 23C) and the notch 21*c* is, respectively, formed in the second plate spring portion 22 and the first plate spring portion 21. However, the present disclosure is not limited to this configuration. The restricting portion 23 (the projection 23C) and the notch 21*c* can be respectively formed in the first plate spring portion 21 and the second plate spring portion 22.

Furthermore, according to the present Embodiment 4, the notch 21*c* is the target into which the projection 23C is fitted. However, the present disclosure is not limited to this configuration. This target may have a shape other than that of the notch 21*c*, as long as the shape enables the fitting in of the projection 23C. For example, the target may be a hole or a dent.

Embodiment 5

Figure 16A:
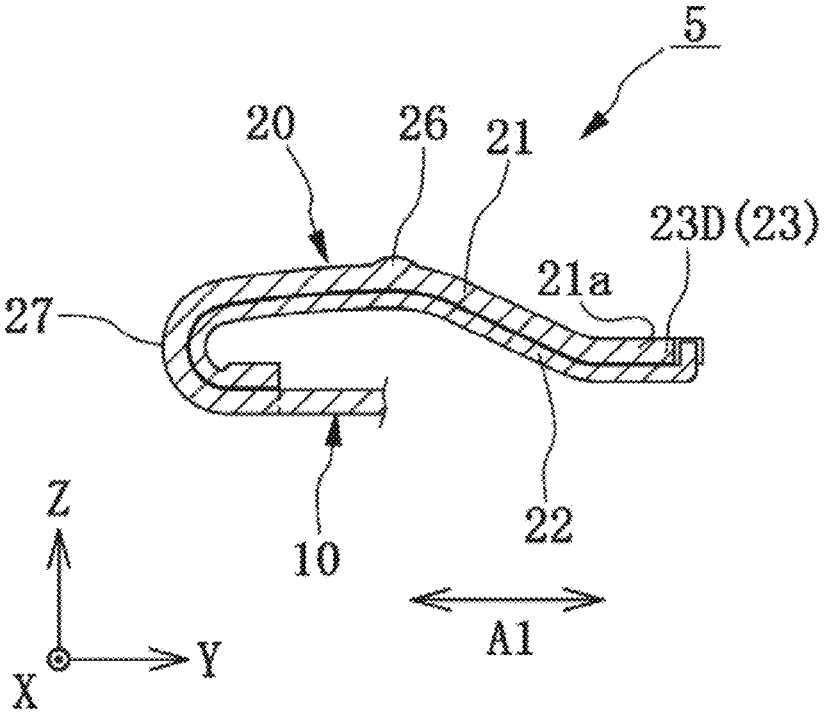
FIG. 16A is a cross-sectional view of an elastic plate according to Embodiment 5.
Figure 16B:
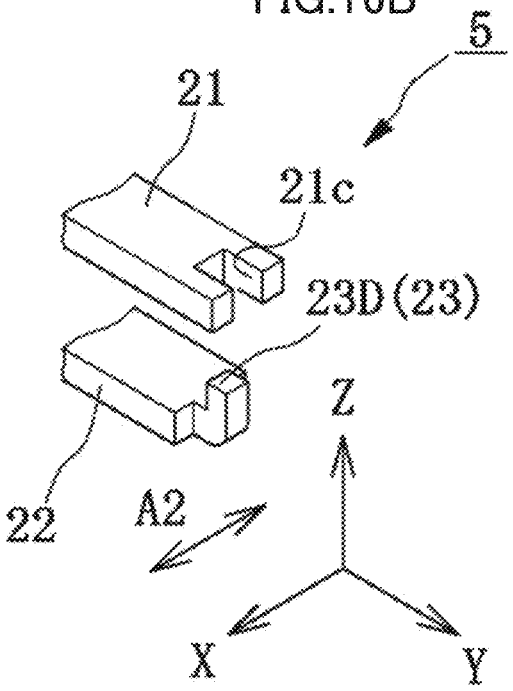
FIG. 16B is an enlarged perspective view of an end of the elastic plate according to Embodiment 5.

In the terminal 4 according to Embodiment 4, the projection 23C is formed by folding up the portion of the second plate spring portion 22, into which a notch is formed near the distal end, centered on an axis parallel to the Y-axis direction. However, the present disclosure is not limited to this configuration. As illustrated in FIGS. 16A and 16B, like the terminal 5 according to Embodiment 5, the projection 23D can be formed by folding up the distal end of the second plate spring portion 22, in which corner portions in two directions are cut out, centered at the axis parallel to the X-axis direction.

According to the present Embodiment 5, the restricting portion 23 (the projection 23D) and the notch 21*c* are respectively formed in the second plate spring portion 22 and the first plate spring portion 21. However, the present disclosure is not limited to this configuration. The restricting portion 23 (the projection 23D) and the notch 21*c* can be respectively formed in the first plate spring portion 21 and the second plate spring portion 22.

In addition, according to the present Embodiment 5, the target into which the projection 23D is to be fitted is the notch 21*c*. However, the present disclosure is not limited to this configuration. This target may be different from the notch 21*c*, as long as the target has a shape that enables the fitting in of the projection 23D. For example, the target can be a hole or a dent.

Other Embodiments

Figure 17:
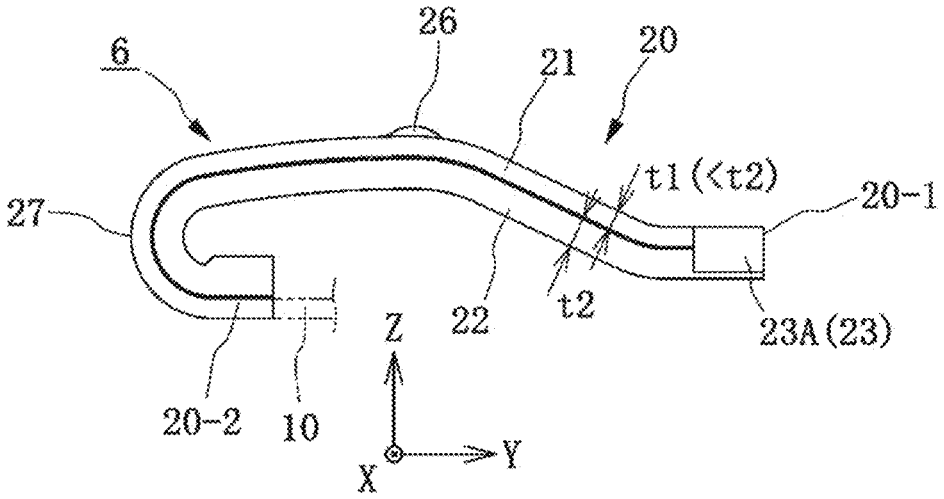
FIG. 17 is a side view of an elastic plate according to Embodiment 6.

Although Embodiments of the present disclosure are described above, the present disclosure is not limited to the above Embodiment 1. For example, in the above Embodiment 1 as illustrated in FIGS. 6A, 6B, 7A, and 7B, the plate thickness t2 of the second plate spring portion 22 is less than the plate thickness t1 of the first plate spring portion 21. However, the present disclosure is not limited to this configuration. The plate thickness t2 of the second plate spring portion 22 can be equal to the plate thickness t1 of the first plate spring portion 21. Alternatively, as in a terminal 6 illustrated in FIG. 17, the plate thickness t2 of the second plate spring portion 22 can be greater than the plate thickness t1 of the first plate spring portion 21. Since the second plate spring portion 22 is provided to enable the elastic plate 20 to have the increased pressure for holding the mating terminal 100, the pressure can be adjusted by changing the plate thickness t2. Note that, since the increased bending radius of the arched portion that is obtained by folding the second plate spring portion 22 centered at the axis C1 parallel to the X-axis direction reduces stress, the plate thickness t2 may be less than the plate thickness t1 of the above Embodiment 1.

Figure 7A:
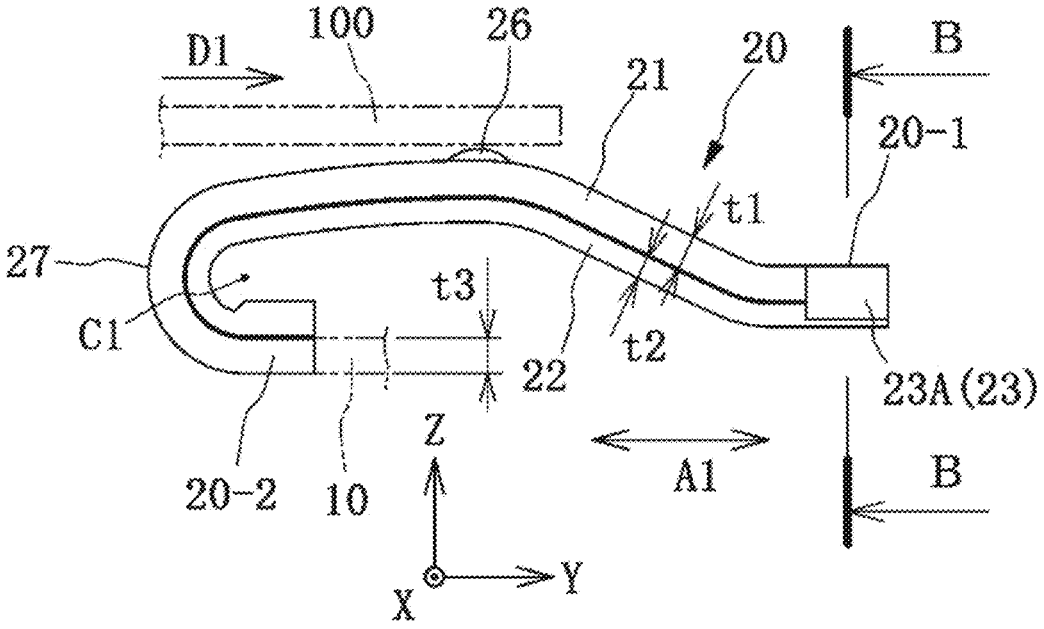
FIG. 7A is a side view of the elastic plate according to Embodiment 1.
Figure 7B:
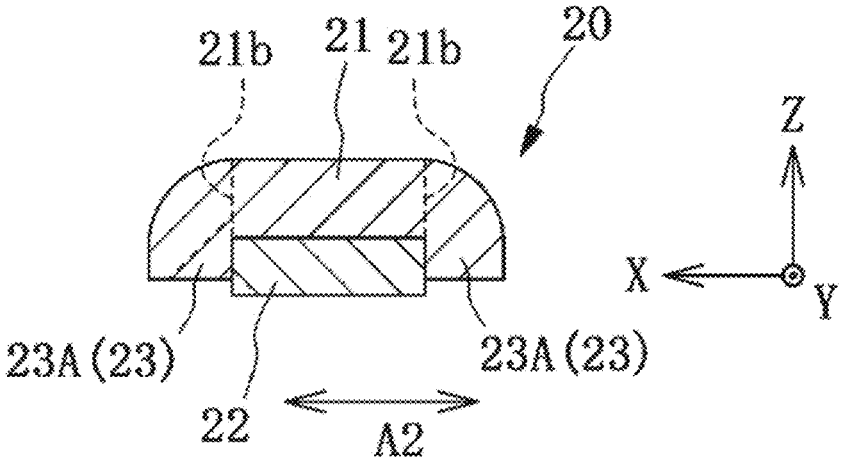
FIG. 7B is a cross-sectional view taken along the line B-B in FIG. 7A.
Figure 18:
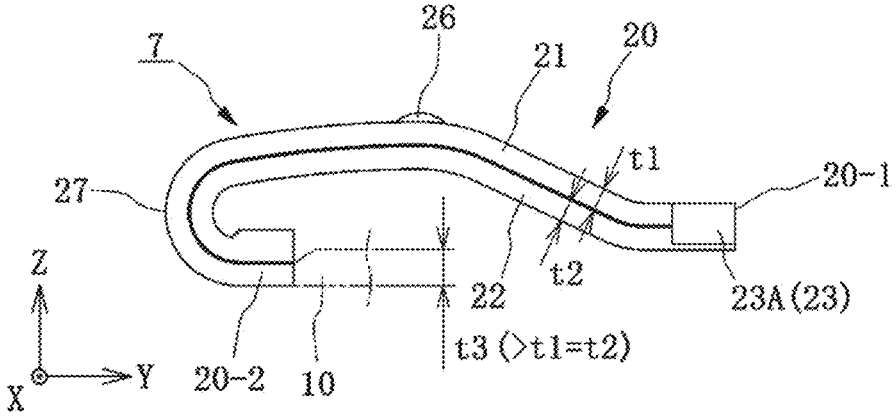
FIG. 18 is a side view of an elastic plate according to Embodiment 7.
Figure 19:
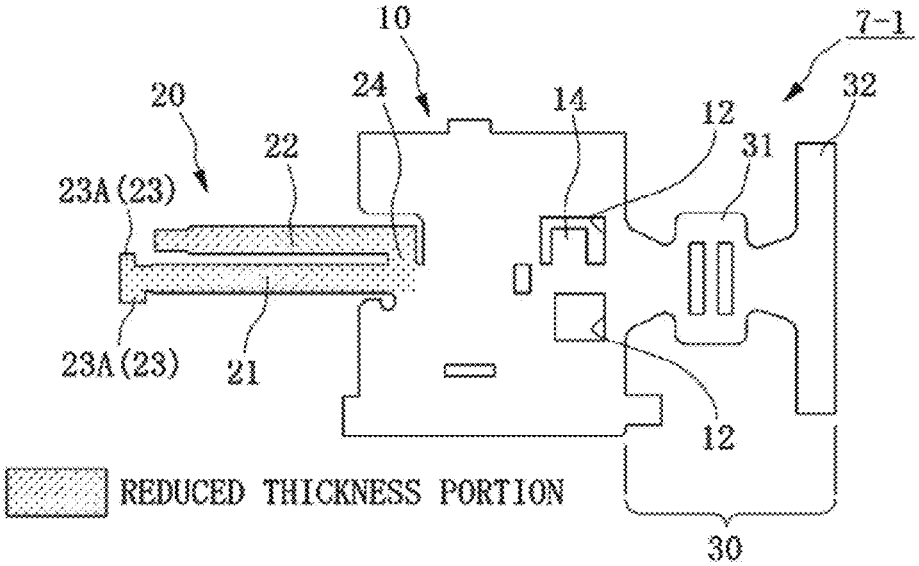
FIG. 19 is a developed view of a terminal according to Embodiment 7.

In the above Embodiments 1 to 5, as illustrated in FIG. 7A, the plate thickness t1 of the first plate spring portion 21 is equal to the plate thickness t3 of the body portion 10, and the plate thickness t2 of the second plate spring portion 22 is less than the plate thickness t1 of the first plate spring portion 21 (t3=t1>t2). However, the present disclosure is not limited to this configuration. As in a terminal 7 illustrated in FIG. 18, the plate thickness t1 of the first plate spring portion 21 may be equal to the plate thickness t2 of the second plate spring portion 22, while each the plate thickness t1 of the first plate spring portion 21 and the plate thickness t2 of the second plate spring portions 22 may be less than the plate thickness t3 of the body portion 10 (t3>t1=t2). In this case, as illustrated in FIG. 19, in the plate 7-1 of the single electrically conductive plate, the thickness of the part that forms the elastic plate 20 is first reduced (made thinner), and then the obtained plate 7-1 is folded back to form the terminal 7

Figure 20A:
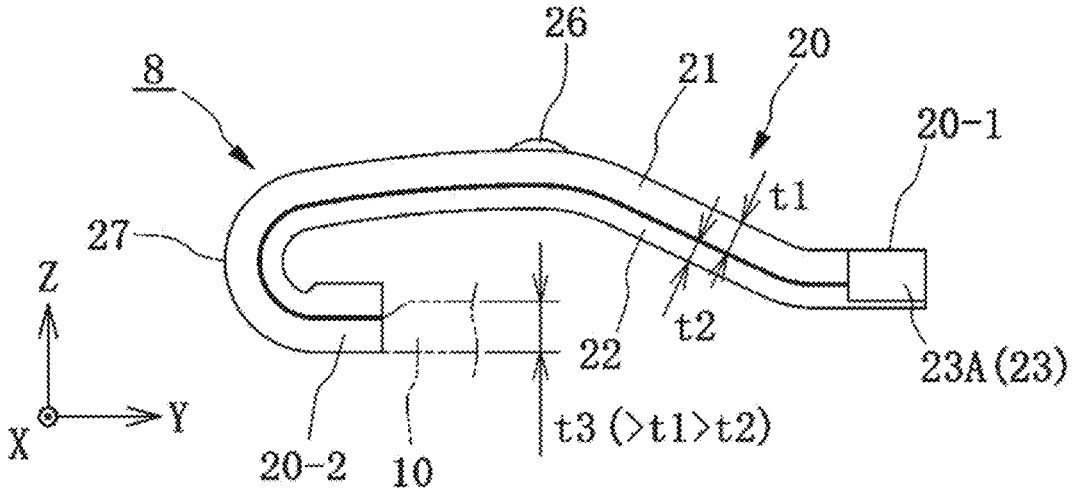
FIG. 20A is side view of an elastic plate according to Embodiment 8.

In addition, in the terminal 7, although the plate thickness t1 of the first plate spring portion 21 is equal to the plate thickness t2 of the second plate spring portion 22, the present disclosure is not limited to this configuration. According to a terminal 8 illustrated in FIG. 20A, the plate thickness t1 of the first plate spring portion 21 may be less than the plate thickness t3 of the body portion 10, and the plate thickness t2 of the second plate spring portion 22 may be less than the plate thickness t1 of the first plate spring portion 21 (t3>t1>t2).

Figure 20B:
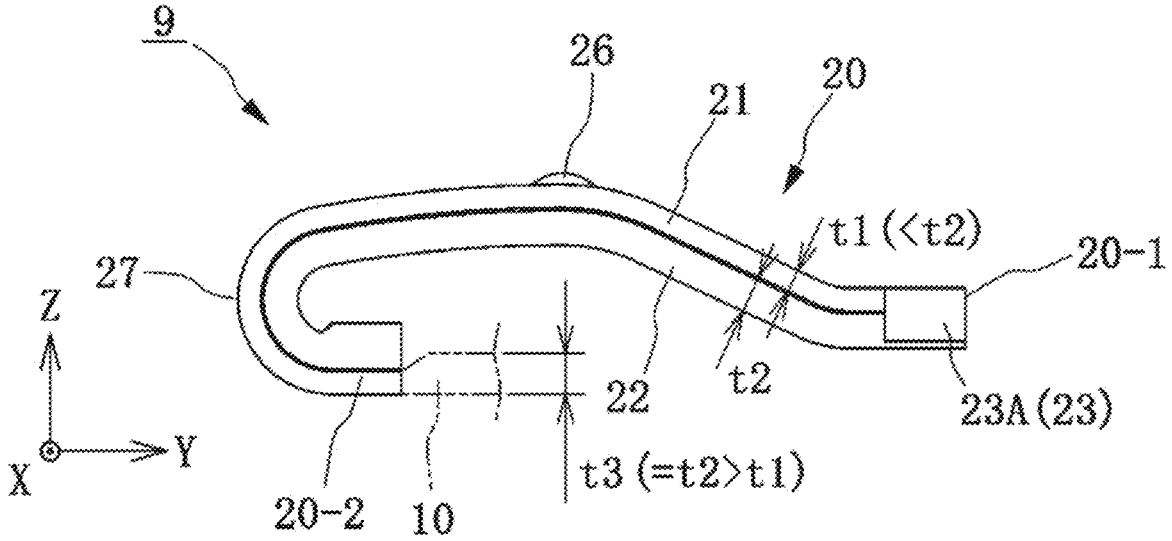
FIG. 20B is a side view of an elastic plate according to Embodiment 9.

In addition, as a terminal 9 illustrated in FIG. 20B, the plate thickness t2 of the second plate spring portion 22 may be equal to the plate thickness t3 of the body portion 10, and the plate thickness t1 of the first plate spring portion 21 may be less than the plate thickness t2 of the second plate spring portion 22 (t3=t2>t1). That is, the plate thickness t1 of the first plate spring portion 21 may be decreased.

Figure 21A:
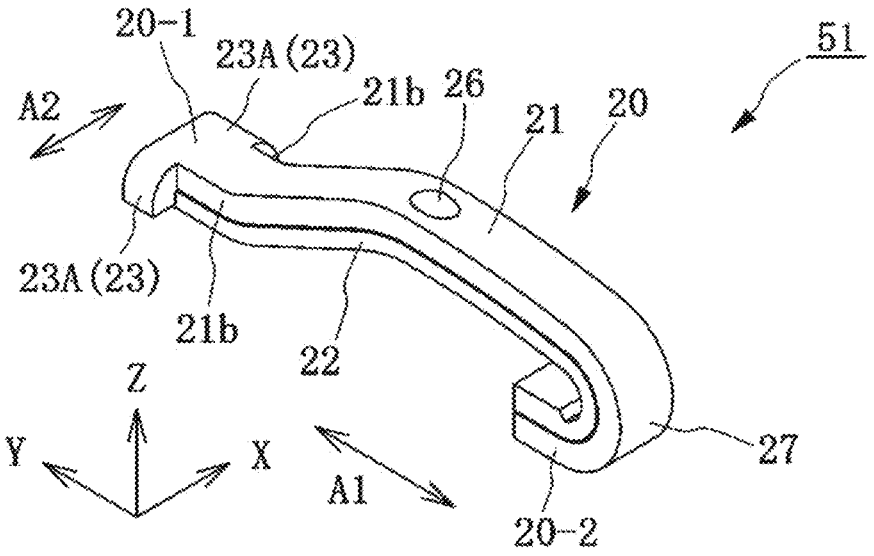
FIG. 21A is a perspective view of an elastic plate according to Embodiment 10.

According to the above Embodiments 1 to 5, the elastic plate 20 is formed from the single plate material as illustrated in FIG. 6B. However, the present disclosure is not limited to this configuration. As a terminal 51 illustrated in FIG. 21A, the two plate spring portions 21 and 22 can be separately obtained and can overlap with each other. In this case, the coupling portion 24 can be omitted.

According to the above Embodiments 1 to 5, as illustrated in FIGS. 6A and 6B, the restricting portion 23 is formed at the first end 20-1 on the distal end side or the second end 20-2 on the base end side of the elastic plate 20. However, the present disclosure is not limited to this configuration. As in a terminal 52 illustrated in FIG. 21B, the restricting portions 23 may be formed at portions other than the first end 20-1 and the second end 20-2. However, when the restricting portion 23 are formed at the portions other than the first end 20-1 and the second end 20-2, elasticity of the elastic plate 20 declines. Thus, the restricting portions 23 may be formed at the first end 20-1 or the second end 20-2.

Figure 21B:
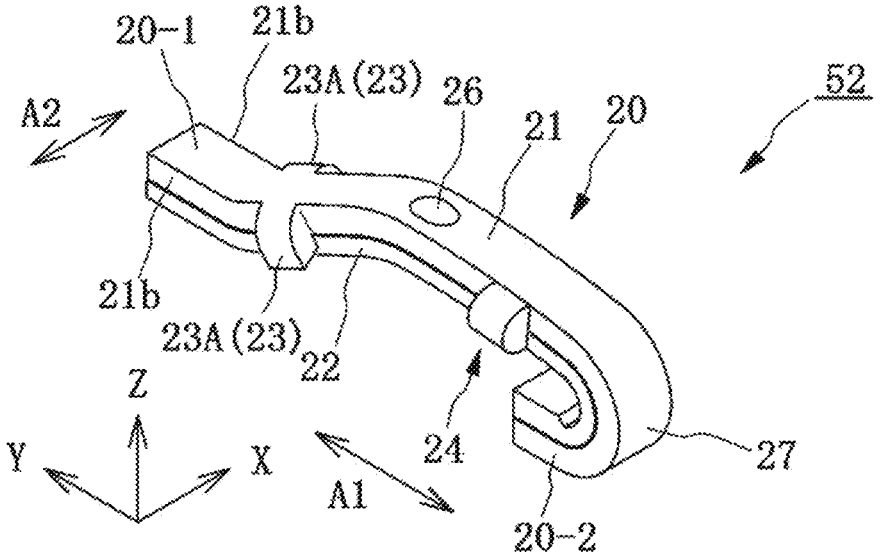
FIG. 21B is a perspective view of an elastic plate according to Embodiment 11.

Similarly, the coupling portion 24 is formed at the first end 20-1 on the distal end side or the second end 20-2 on the base end side of the elastic plate 20. However, the present disclosure is not limited to this configuration. As illustrated in FIG. 21B, the coupling portion 24 may be formed at portions other than the first end 20-1 and second end 20-2. Note that when the coupling portion 24 is formed at the portions other than the first end 20-1 and the second end 20-2, elasticity of the elastic plate 20 is declines. Thus, the coupling portion 24 is may be formed at the first end 20-1 or the second end 20-2.

According to the above Embodiments 1 to 5, a single restricting portion 23 is formed at the elastic plate 20 as illustrated in FIGS. 6A and 6B. However, the present disclosure is not limited to this configuration. Two or more restricting portions 23 may be formed. Similarly, a single coupling portion 24 is formed at the elastic plate 20. However, the present disclosure is not limited to this configuration. Two or more coupling portions 24 may be formed.

The foregoing describes some example embodiments for explanatory purposes. Although the foregoing discussion has presented specific embodiments, persons skilled in the art will recognize that changes may be made in form and detail without departing from the broader spirit and scope of the invention. Accordingly, the specification and drawings are to be regarded in an illustrative rather than a restrictive sense. This detailed description, therefore, is not to be taken in a limiting sense, and the scope of the invention is defined only by the included claims, along with the full range of equivalents to which such claims are entitled.

REFERENCE SIGNS LIST

1, 1A, 2, 3, 4, 5, 6, 7, 8, 9, 51, 52: Terminal
1-1, 2-1, 7-1: Plate
10: Body portion
10A, 10B: Top plate
10C: Bottom plate
10R, 10L: Sidewall plate
11: Insertion opening
12: Exposure opening
13: Lance locking member
14: Upside-down insertion preventing projection
20: Elastic plate
20-1: First end
20-2: Second end
21: First plate spring portion
21*a*: Hole
21*b*: Side end face (first plate spring portion)
21*c*: Notch
22: Second plate spring portion
23: Restricting portion
23A, 23B, 23C, 23D: Projection
24: Coupling portion
25: Bent portion
26: Contact portion
27: Arched portion
30: Crimp portion
31: Conductor crimping part
32: Sheath holder
40: Carrier
100: Mating terminal
200: Electric wire
201: Core
202: Sheath
A1: Tube axial direction
A2: Lateral direction
C1, C2, C3: axis
D1: Insertion direction
S: Space
W2, W2: Width
L1: Length
t1, t2, t3: Plate thickness

What is claimed is:

1. A terminal comprising:

a body portion made of an electrically conductive material, having a tubular shape extending in a tube axial direction, and comprising an insertion opening through which a mating terminal is to be inserted; and an elastic plate made of an electrically conductive material, extending inside the body portion in the tube axial direction, and comprising an arched portion folded back to face the insertion opening, the elastic plate being configured to contact with the mating terminal upon insertion of the mating terminal into the insertion opening, wherein the elastic plate includes a first plate spring portion and a second plate spring portion overlapping the first plate spring portion, the arched portion includes a first portion that is a portion of the first plate spring portion and a second portion that is a portion of the second plate spring portion, the second portion is disposed on an inner side of the first portion, the elastic plate has a restricting portion, the restricting portion being formed at one of the first plate spring portion and the second plate spring portion, and is configured to restrict displacement between the first plate spring portion and the second plate spring portion, and the restricting portion allows a relative sliding movement of the first plate spring portion and the second plate spring portion in the tube axial direction, and restricts a relative sliding movement of the first plate spring portion and the second plate spring portion in a direction that is orthogonal to the tube axial direction and parallel to a plate surface of the first plate spring portion.

2. The terminal according to claim 1, wherein the restricting portion is a pair of projections sandwiching another one of the first plate spring portion and the second plate spring portion.

3. The terminal according to claim 2, wherein the pair of projections protrudes and is folded back from both side end faces of the one of the first plate spring portion and the second plate spring portion.

4. The terminal according to claim 2, wherein the body portion has exposure openings that expose the pair of the projections to the outside of the body portion.

5. The terminal according to claim 1, wherein another one of the first plate spring portion and the second plate spring portion has a hole, a dent, or a notch, and the restricting portion is formed at the one of the first plate spring portion and the second plate spring portion, and is the projection that fits in the hole, the dent, or the notch.

6. The terminal according to claim 5, wherein the projection is formed by pressing the one of the first plate spring portion and the second plate spring portion from a surface opposite to surfaces of the first plate spring portion and the second plate spring portion facing each other.

7. The terminal according to claim 5, wherein the projection is formed by cutting and raising up the one of the first plate spring portion and the second plate spring portion.

8. The terminal according to claim 1, wherein the elastic plate has a first end on a distal end side that extends and is folded such that the arched portion faces the insertion opening, and the restricting portion is formed at the first end.

9. The terminal according to claim 1, wherein the elastic plate has a coupling portion that couples the first plate spring portion and the second plate spring portion to each other, and the first plate spring portion, the second plate spring portion, and the coupling portion are formed integrally from a single electrically conductive plate.

10. The terminal according to claim 9, wherein the elastic plate has, on a base end side, a second end that is connected to a portion where the insertion opening is formed, and the coupling portion is formed at the second end.

11. The terminal according to claim 1, wherein the first plate spring portion and the second plate spring portion are separately formed from different electrically conductive plates.

12. The terminal according to claim 1, wherein a plate thickness of the second plate spring portion is less than a plate thickness of the first plate spring portion.

13. The terminal according to claim 12, wherein the first plate spring portion has a contact portion that is to be in contact with the mating terminal, and the second plate spring portion is disposed, at an inner side, on the first plate spring portion folded back such that an arched portion faces the insertion opening.

* * * * *